US007134719B2

(12) United States Patent
Moglin et al.

(10) Patent No.: US 7,134,719 B2
(45) Date of Patent: Nov. 14, 2006

(54) PERIPHERAL SUPPORT APPARATUS AND METHOD

(75) Inventors: Benjamin Alexander Moglin, Hazenmore (CA); Richard Nelson Stieler, Vancouver (CA); Allan Quattrin, Vancouver (CA)

(73) Assignee: P--CE Computers, Inc., Vancouver (CA)

( * ) Notice: Subject to any disclaimer, the term of this patent is extended or adjusted under 35 U.S.C. 154(b) by 237 days.

(21) Appl. No.: 10/712,395

(22) Filed: Nov. 14, 2003

(65) Prior Publication Data

US 2004/0172887 A1 Sep. 9, 2004

Related U.S. Application Data

(60) Provisional application No. 60/426,447, filed on Nov. 15, 2002.

(51) Int. Cl.
*A47C 7/62* (2006.01)
*A47B 83/02* (2006.01)

(52) U.S. Cl. ..... 297/217.3; 297/170; 297/172; 297/188.21; 297/217.1

(58) Field of Classification Search ..... 297/188.2, 297/188.01, 188.21, 217.3, 423.18, 423.4, 297/170, 172; 312/223.3, 223.2
See application file for complete search history.

(56) References Cited

U.S. PATENT DOCUMENTS 3,601,443 A * 8/1971 Jones ..... 297/188.21
3,712,669 A * 1/1973 Cates ..... 297/188.21
3,813,147 A * 5/1974 Rick ..... 297/146
4,136,908 A * 1/1979 Crayne ..... 297/188.21
4,365,561 A 12/1982 Tellier et al.
4,645,167 A * 2/1987 Hardwick ..... 248/520
4,767,160 A * 8/1988 Mengshoel et al. .... 297/423.12
4,779,922 A 10/1988 Cooper
4,880,270 A 11/1989 Cooper
4,915,450 A 4/1990 Cooper
5,056,864 A 10/1991 Cooper
5,098,160 A 3/1992 Moore et al.
5,522,323 A 6/1996 Richard
5,542,746 A * 8/1996 Bujaryn ..... 297/423.12
5,779,305 A * 7/1998 Hocking ..... 297/217.4
5,803,547 A * 9/1998 Brown ..... 297/344.23
5,909,934 A 6/1999 McGraw
6,056,363 A 5/2000 Maddox
6,098,936 A 8/2000 Birrell
6,102,476 A 8/2000 May et al.
6,248,014 B1 6/2001 Collier
6,315,358 B1 11/2001 Baru
6,354,044 B1 * 3/2002 Lagace, Jr. ..... 52/79.5
6,394,402 B1 5/2002 Coonan et al.
6,422,646 B1 * 7/2002 McNally ..... 297/170
D465,343 S 11/2002 Daneault
6,644,748 B1 11/2003 Tholkes et al.

(Continued)

*Primary Examiner*—Peter R. Brown
*Assistant Examiner*—Tania Abraham
(74) *Attorney, Agent, or Firm*—Matthew A. Pequignot; Hall, Vande Sande & Pequignot LLP

(57) ABSTRACT

A work station having a base, a user support affixed to the base; and an overhead hanger affixed to said base. The overhead hanger has a rear portion extending upwardly behind the user support and an overhead portion extending forwardly above the user support a sufficient distance so that when a user is positioned in the user support, the overhead portion is above the user and a peripheral mounting system affixable to the overhead portion proximate a distal end of the overhead portion.

11 Claims, 6 Drawing Sheets

U.S. PATENT DOCUMENTS 6,776,452 B1 * 8/2004 Onishi ..... 297/170
6,916,065 B1 * 7/2005 Park ..... 297/217.1
2004/0007907 A1 * 1/2004 DiRe ..... 297/217.3
2005/0127724 A1 * 6/2005 Irwin et al. ..... 297/188.01

* cited by examiner

PERIPHERAL SUPPORT APPARATUS AND METHOD

RELATED APPLICATIONS

This application claims the benefit of prior file provisional application, Application No. 60/426,447 filed Nov. 15, 2002.

FIELD OF INVENTION

This invention relates to a an ergonomically designed work station which supports computer peripherals in a location compatible with a user and supports the user in a position which minimizes stress on the human body.

BACKGROUND OF THE INVENTION

Conventional computer work stations consist of a desk having a location for mounting of a computer monitor, a keyboard and a computer tower. The user generally sits on an office chair in front of the monitor. Such arrangements have been notorious for inducing backpain, carpal tunnel syndrome and other problems. A few workstations were designed attempting to integrate human comfort and health with performance. However, such workstations have been made up of many different parts interconnected or free standing. Moreover, some of these parts typically block off access by a user to a chair. Finally, moving such systems involves moving awkwardly interconnected elements such as a chair and a desk as well as free standing stands for holding monitors and side tables.

It is an object of the invention to provide an ergonomic workstation in which the entire workstation is integrated and the user area is accessible from either side.

SUMMARY OF THE INVENTION

According to the invention there is provided a work station having a base; a user support affixed to the base; and an overhead hanger affixed to the base. The overhead hanger has a rear portion extending upwardly behind the user support and an overhead portion extending forwardly above the user support a sufficient distance so that when a user is positioned in the user support, the overhead portion is above the user. The overhead hanger further includes a peripheral mounting system affixable to the overhead portion, proximate a distal end of the overhead portion. A horizontally disposed pipe affixed to the base, a vertically oriented sleeve affixed to a distal end of the pipe, a rod telescopically slidable and rotatable within the sleeve, the rod having a horizontal portion extending from a top end thereof and a computer mouse tray and keypad tray, each independently positionable about the horizontal portion.

The work station may include a foot rest assembly affixable to the base and positioned to receive and support a user's feet when the user is in the user support.

Preferably the user support is an ergonomically designed chair having a head support.

The work station may further include a plurality of arms affixable to the base support with each arm having a wheel at a distal end thereof, said arms radially positioned so as to support said work station in a stable position.

The work station may have a CPU mounting assembly affixed to the rear portion.

The user support may be attached to a vertical bar that telescopes within a sleeve affixed to the base.

The overhead portion may have a block affixed to an end thereof, a mounting pipe extending from the block and an articulating arm attached at one end to the mounting pipe and at another end to the peripheral device.

In another aspect of the invention there is presented a method of providing a work station environment, which includes providing a user area defined by a base, a user support affixed to the base, and an overhead hanger affixed to the base, having a rear portion extending upwardly behind the user support and an overhead portion extending forwardly above the user support a sufficient distance so that when a user is positioned in the user support, the overhead portion is above the user. The method provides a peripheral mounting system affixable to the overhead portion proximate a distal end of the overhead portion. The method further provides a horizontally disposed pipe affixed to the base, a vertically oriented sleeve affixed to a distal end of the pipe, a rod telescopically slidable and rotatable within the sleeve, the rod having a horizontal portion extending from a top end thereof and a computer mouse tray and keypad tray, each independently positionable about the horizontal portion.

The method may further provide a foot rest assembly affixable to the base and positioned to receive and support a user's feet when the user is in the user support.

Advantageously, the method includes providing a plurality of legs each affixed at one end to the base and at an opposite end having a wheel affixed thereto, the legs being radially spaced apart so that said work station is stable on a flat surface.

The apparatus is not side-dependent and has a symmetry that allows it to be placed near a wall on either side thereof, without affecting its use. It also provides free space for the legs and feet of a user.

The processor may be any type of signal or data processor and may include a computer, an audio processor such as a home theatre amplifier, a VCR, a DVD player and/or recorder, a tape deck, a CD player, or a game platform for example.

While ordinarily the peripheral device will be a computer monitor it could also be a speaker or a platform for holding a computer input device or a game controller.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION OF THE INVENTION

Figure 1:
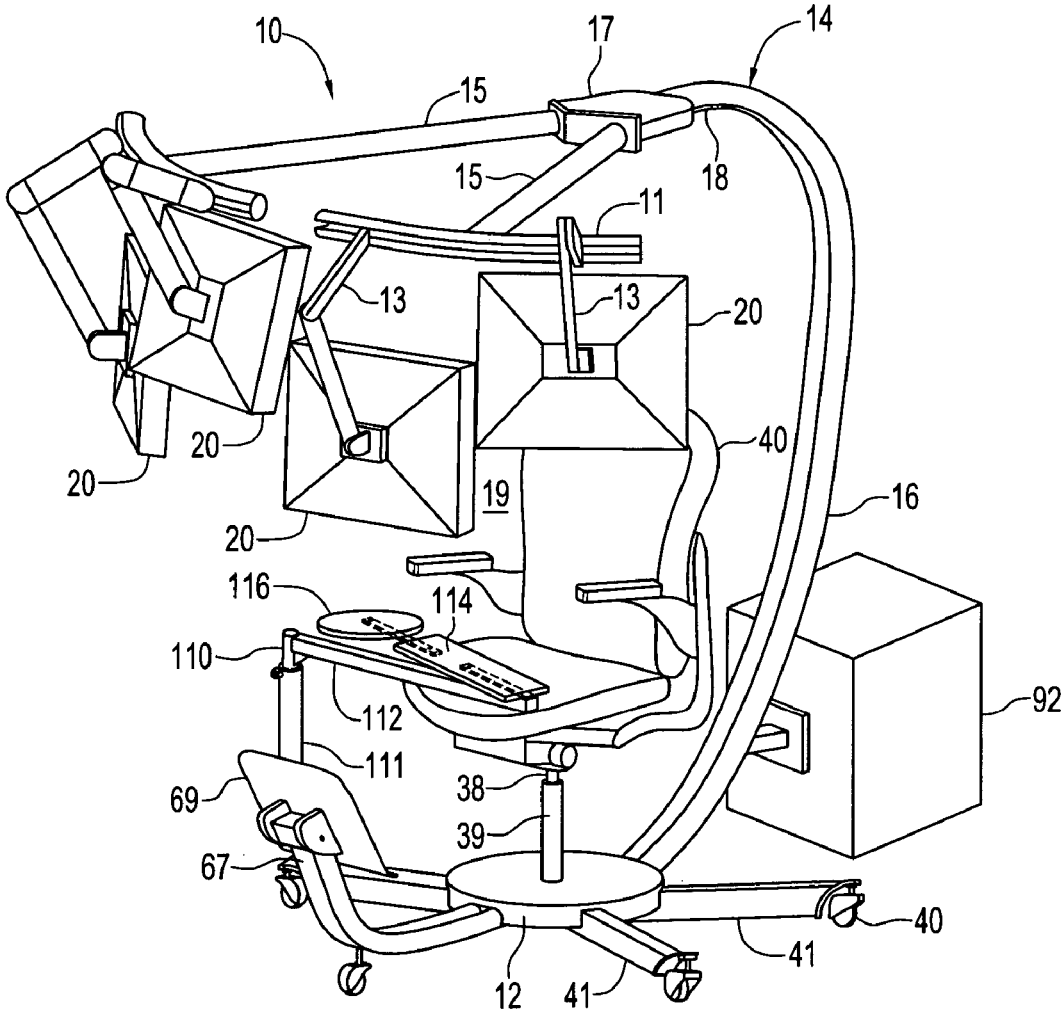
FIG. 1 is a perspective view of a workstation which can accommodate many different monitors.
Figure 4:
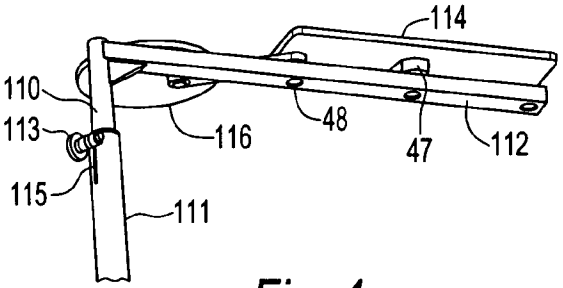
FIG. 4 is a top view of a mouse and keypad support arrangement.
Figure 5:
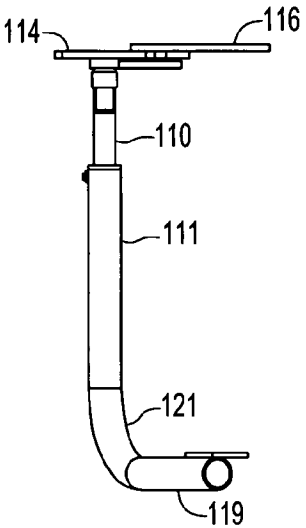
FIG. 5 is a left side elevation view of the support of FIG. 2.
Figure 3:
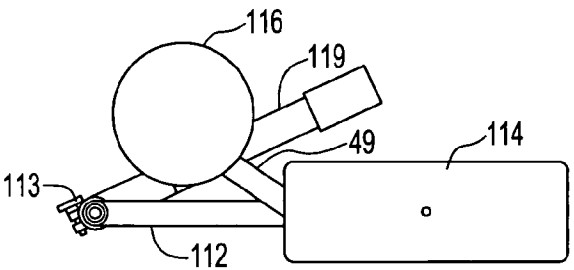
FIG. 3 is a plan view of the apparatus shown in FIG. 1.
Figure 2:
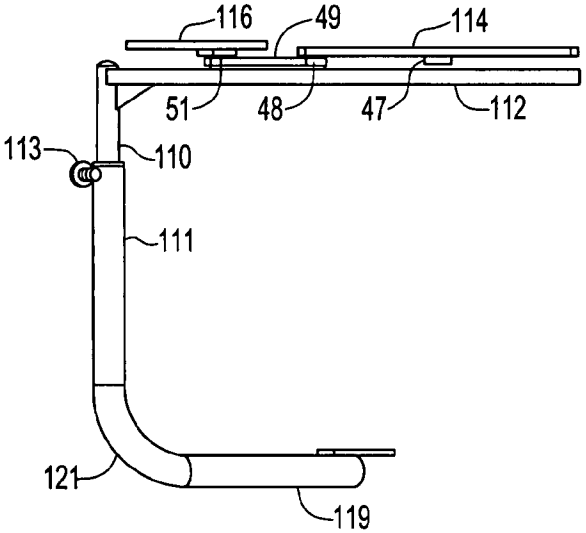
FIG. 2 is a side elevation view of a mouse and keypad support arrangement.

Referring to FIG. 1, an integrated workstation 10 includes a base 12 operable to rest on a support surface (not shown) and an overhead hanger 14 connected to the base 12. The overhead hanger 14 having a rear portion 16 extending upwardly relative to the base 12 and having at least one overhead portion 18 supported by the rear portion 16 and extending forwardly of the rear portion 16 sufficiently high above the base 12 such that a user may be received in a user area 19 between the overhead portion 18, and the base 12 and forwardly of the rear portion 16. The overhead portion 18 has an expander block 17 in which two arms 15 are connected and extend forwardly terminating in rails 11. Rails 11 extend arcuately and horizontally from side to side on either side of distal ends of associated arms 15. To each rail 11 there are affixed pivotal arms 13 which couple to the back of computer monitors 20 and provide articulating movement to the latter. The computer monitors could be replaced by any peripheral device that requires viewing.

An ergonomically designed chair 40 complete with headrest (not shown) is mounted in the base 12. The mounting arrangement consists of an outer sleeve 39 rigidly affixed to the base and a telescoping rod 38 that slides in sleeve 39.

A computer keyboard and mouse support, 114 and 116 are pivotally affixed to a pivotal bar 112 that is supported at one end by a vertical arm 110. As seen in more detail in FIGS. 2 to 5, the vertical arm 110 telescopes and pivots in a sleeve 111 that connects to a 90 degree elbow 121 and a straight pipe 119. Straight pipe 119 couples into base 12. A user may pivot vertical arm 110, pivotal bar 112 about vertical arm 110, a computer keyboard tray 114 about a pivot block 47 and mouse support 116 about a pivot block 51 to the desired position once seated in seat 40. Mouse tray pivots about connector 49 which pivots with respect to keypad tray 114 about point 48. A CPU 92 is mounted to rear portion 16.

Figure 6:
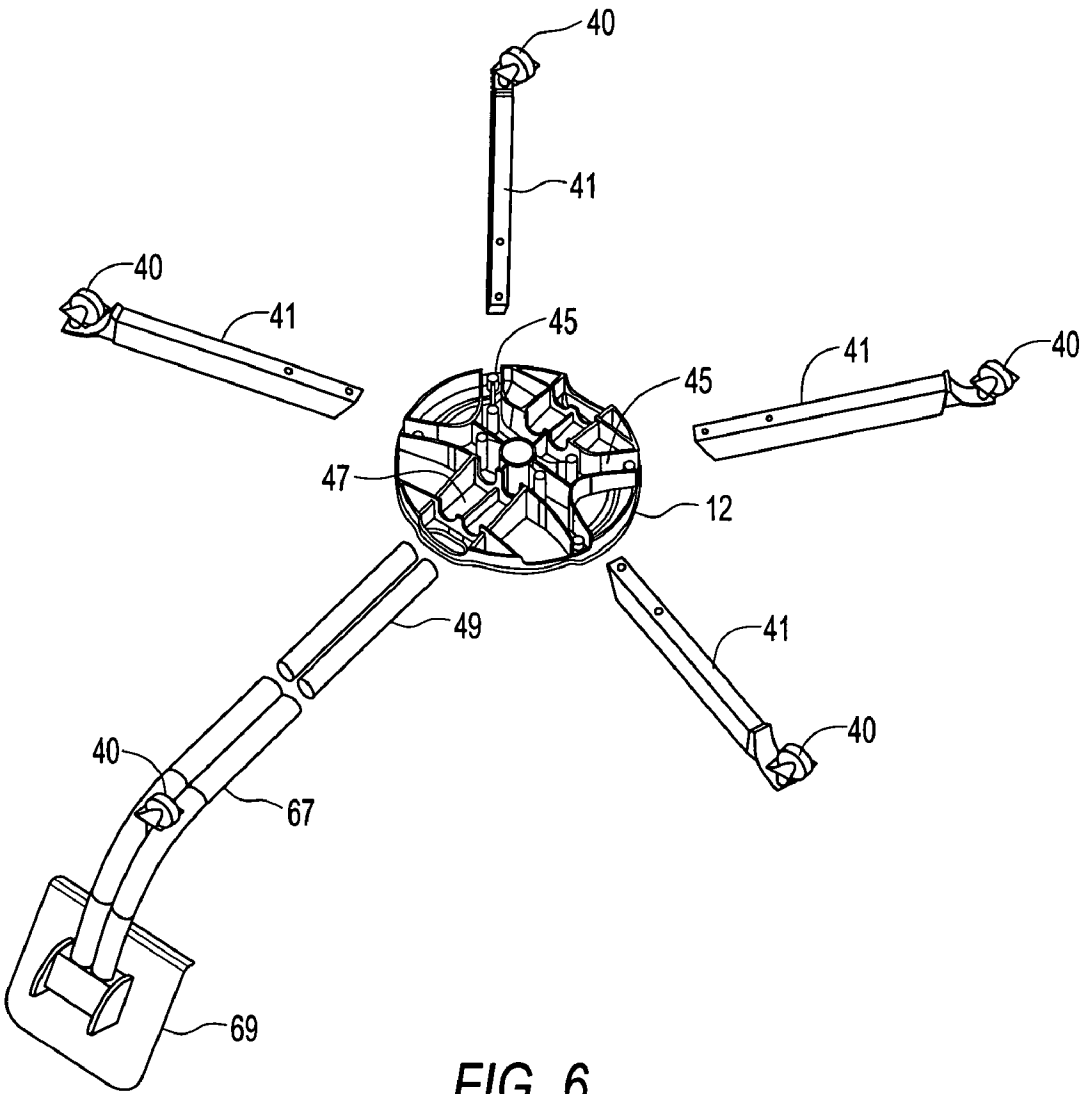
FIG. 6 is an exploded view of the base, support arms and casters and foot support.

Referring to FIG. 6, extending radially from base 12 are four support legs 41 at a distal end of each of which is a caster 40. The ends opposite casters 40 each slide into receptacles 45 in the base 12. Also fitting into a receptacle 47 in base 12 is a double pipe 49 that rigidly connects to second section of double pipe 67 that curves upwardly and terminates in a foot rest 69. A caster 40 is also mounted on an underside of double pipe 67. The legs 41 and double pipe 49 are held in place by a bottom cover plate (not shown).

Similarly, the chair 40 may be replaced by one which places a user in a more reclined position which is particularly desirable for those with back problems. In any event, the chair 40 or any of the other alternative user support arrangements co-operate or facilitate positioning a user in a user area 19.

In use a user enters user area 19 from either side of chair 40 and is seated in chair 40. Any adjustments to the monitors 20 and to the height of chair 40 required for the user are made. Adjustment to the position of the foot rest can be made by sliding double pipes 67 over double pipes 49 until a desired positioning of foot rest 69 is achieved. A lock not shown is engaged to hold the two double pipes 67 and 49 together without movement. The entire workstation 10 can be moved by simply rolling it on casters 41. Since all peripherals supports are affixed to base 12, there is no need to move separate elements of the workstation 10.

Figure 7:
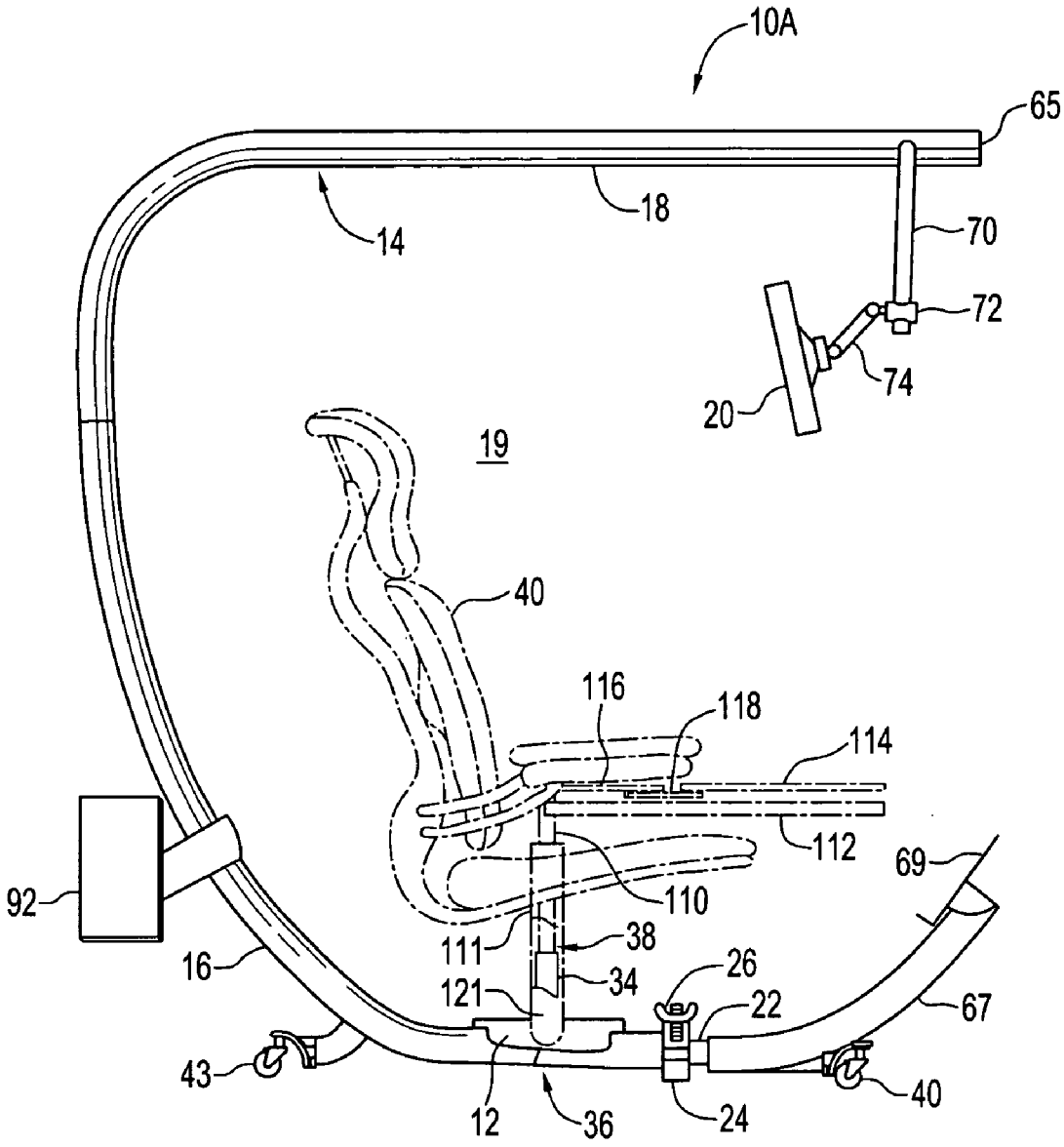
FIG. 7 is a side elevation view of a work station 10A.

An alternative workstation 10A has an overhead hanger 14 arrangement, seen in FIG. 7, consisting of a straight portion of double pipe 18 that terminates in an end 65. A plurality of downwardly, arcuately shaped rods 70 extend from overhead portion 18 and is rigidly mounted to the latter. A split ring clamp 72 is positionable along rods 70 and can be locked in any position therealong. A positioning arm 74 is coupled to both clamp 72 and monitor 20 by a ball and socket joint. Otherwise workstation 10A is identical to workstation 10 shown in FIG. 1.

Figure 8:
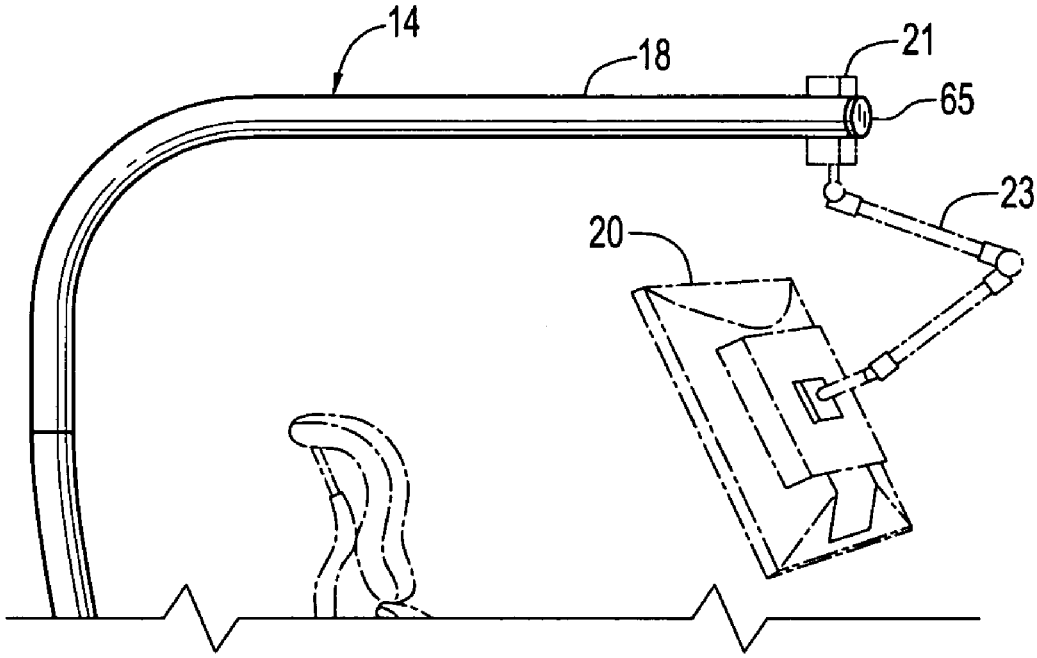
FIG. 8 is a side elevation view of an alternative overhead peripheral support.
Figure 9:
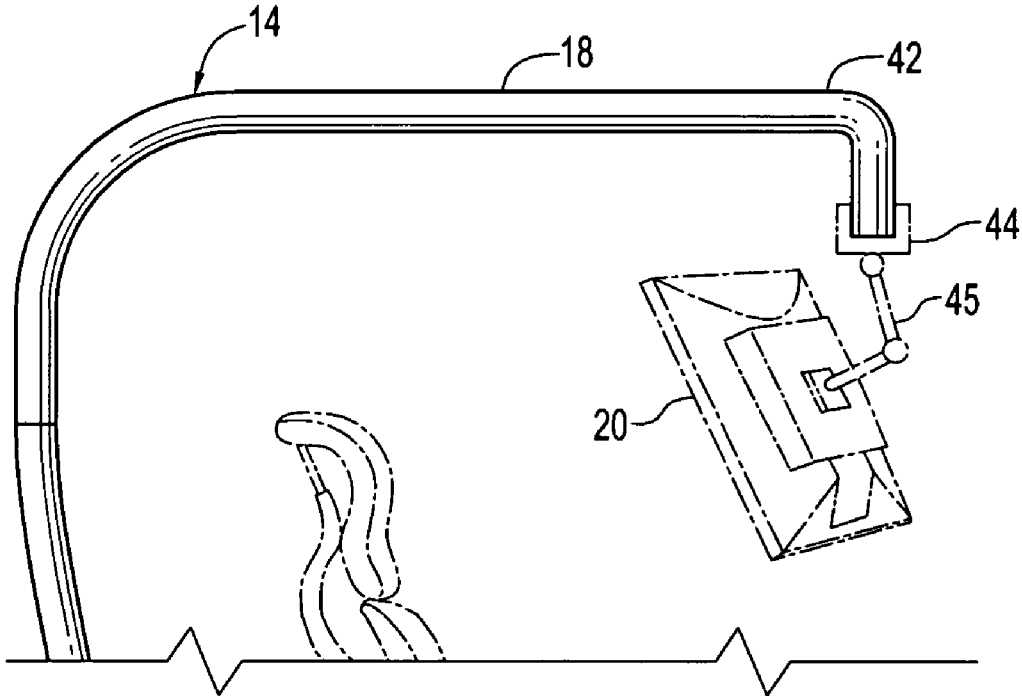
FIG. 9 is a side elevation view of yet another alternative overhead peripheral support.

Referring to FIG. 8, an example of an alternative mount to hanger 14 is seen to include a split right clamp 21 mounted on overhead portion 18 can be locked at any position therealong. An articulating arm 23 connects to clamp 21 and to monitor 20. Although normally clamp 21 is suitable for a wide range of users, for persons of unusual height or poor eyesight some adjustment of clamp 21 may be desired.

Yet another variant of the mounting arrangement to overhead hanger 14 is shown. Here a right angle section of double pipe 42 fits over an end of double pipe 18 and is locked thereto. Clamp 44 fits over an end of a right angle pipe 42 and is locked to the end of right angle pipe 42. An articulating arm 45 couples to both clamp 44 and to monitor 20. Obviously there are various other different mounting arrangements that can be utilized.

It will also be appreciated that there are various different base support configurations that can be used such as one that is fixed rather than being on casters. The CPU 92 can be mounted on the floor or to the back of the chair 40.

Various features of the several different embodiments of the invention described herein may be used in combination with other features described herein to produce combinations of features other than those specifically described above and such combinations are intended to be within the scope of this invention.

While specific embodiments of the invention have been described and illustrated, such embodiments should be considered illustrative of the invention only and not as limiting the invention.

We claim:

1. A work station comprising:

(a) a base;

(b) a user support affixed to said base;

(c) an overhead hanger immovably affixed to said base, having a rear portion extending upwardly behind said user support and an overhead portion extending forwardly above said user support a sufficient distance so that when a user is positioned in said user support said overhead portion is above said user;

(d) a peripheral mounting system affixable to said overhead portion proximate a distal end of said overhead portion; and (e) a horizontally disposed pipe affixed to said base, a vertically oriented sleeve affixed to a distal end of said pipe, a rod telescopically slidable and rotatable within said sleeve, said rod having a horizontal portion extending from a top end thereof and a computer mouse tray and keypad tray, each independently positionable about said horizontal portion.

2. The work station of claim 1, including a foot rest assembly affixable to said base and positioned to receive and support a user's feet when the user is in said user support.

3. The work station of claim 1, wherein said user support is an ergonomically designed chair having a head support.

4. The work station of claim 1, including a plurality of arms affixable to said base support and having casters at a distal end thereof, said arms radially positioned so as to support said work station in a stable position.

5. The work station of claim 4, including a CPU mounting assembly affixed to said rear portion.

6. The work station of claim 1, wherein said user support is attached to a vertical bar that telescopes within a sleeve affixed to said base.

7. The work station of claim 1, wherein said peripheral mounting system has a block affixed to said overhead portion, and an articulating arm attached to said block, and attachable at another end to a peripheral device.

8. The work station of claim 7 wherein said peripheral device is a computer monitor.

9. A method of providing a work station environment, comprising:

(a) providing a user area defined by a base, a user support affixed to said base, an overhead hanger affixed to said base, having a rear portion extending upwardly behind said user support and an overhead portion extending forwardly above said user support a sufficient distance so that when a user is positioned in said user support said overhead portion is above said user;

(b) providing a peripheral mounting system affixable to said overhead portion proximate a distal end of said overhead portion; and (c) providing a horizontally disposed pipe affixed to said base, a vertically oriented sleeve affixed to a distal end of said pipe, a rod telescopically slidable and rotatable within said sleeve, said rod having a horizontal portion extending from a top end thereof and a computer mouse tray and keypad tray, each independently positionable about said horizontal portion.

10. The method of claim 9, including providing a foot rest assembly affixable to said base and positioned to receive and support a user's feet when the user is in said user support.

11. The method of claim 9, including providing a plurality of legs each affixed at one end to said base and at an opposite end having a caster affixed thereto, said legs being radially spaced apart so that said work station is stable on a flat surface.

* * * * *